United States Patent [19]

Dowthwaite et al.

[11] 4,323,425

[45] Apr. 6, 1982

[54] PAPER SIZING

[75] Inventors: Edwin Dowthwaite, Frampton; Ian R. Hiskens, Oldfield Park, both of England

[73] Assignee: Tenneco Chemicals, Inc., Piscataway, N.J.

[21] Appl. No.: 132,505

[22] Filed: Mar. 21, 1980

Related U.S. Application Data

[60] Continuation of Ser. No. 730,908, Oct. 8, 1976, abandoned, which is a continuation of Ser. No. 577,485, May 14, 1975, abandoned, which is a division of Ser. No. 435,561, Jan. 22, 1974, Pat. No. 3,906,142.

[30] Foreign Application Priority Data

Jan. 22, 1973 [GB] United Kingdom ..... 3145/73

[51] Int. Cl.[3] ..... D21H 3/34; D21H 3/36

[52] U.S. Cl. ..... 162/168 N; 162/180

[58] Field of Search ..... 162/168 N, 180, 164 R

[56] References Cited

U.S. PATENT DOCUMENTS 2,772,966 12/1956 Daniel et al. ..... 162/180

3,376,159 4/1968 Drennen et al. .

3,406,139 10/1968 Hurwitz et al. ..... 260/29.6 HN

FOREIGN PATENT DOCUMENTS 335902 10/1930 United Kingdom ..... 162/180

424230 2/1935 United Kingdom ..... 162/180

1003972 9/1965 United Kingdom ..... 162/180

1412254 10/1975 United Kingdom ..... 162/180

OTHER PUBLICATIONS

Hotz et al., *Paper Trade Journal*, Feb. 20, 1941, pp. 95–99.

*Primary Examiner*—William F. Smith

*Attorney, Agent, or Firm*—James P. Scullin; Thomas E. Spath

[57] ABSTRACT

This invention relates to improved rosin sizes, and to improved methods for preparing sized paper. In one embodiment, sized paper is prepared by adding the improved rosin size and a polyamine retention aid to a pulp slurry before sheet formation, without the use of aluminum sulfate. In another embodiment, paper is surface-sized with the improved rosin size in the absence of both aluminum sulfate and retention aids.

7 Claims, No Drawings

PAPER SIZING

This is a continuation of Ser. No. 730,908, filed Oct. 8, 1976 abandoned which is a continuation of Ser. No. 577,485 filed May 14, 1975 abandoned, which is a division of Ser. No. 435,561 filed Jan. 22, 1974 now U.S. Pat. No. 3,906,142.

The present invention relates to paper making and, in particular, the paper sizing art and provides high free-rosin sizing agents based on rosin, which can be retained on cellulosic fibres by the use of a polyamine and which will give the desired sizing effect, irrespective of the presence of alum or other precipitating or flocculating agents. The paper sizing agents of the invention also have the advantage that they can be added to paper stock which has a pH in the range of 4 to 10.

The high free-rosin sizing agents of this invention may alternatively be added to the paper sheet at any convenient situation, after its formation and before it is fully dried. They may also be added in admixture with other commonly used substances for the surface treatment of paper, either at the size press or at a coating apparatus. When high free-rosin sizing agents, made in accordance with the present disclosure, are added to the surface of the paper sheet, no polyamine retention aid is required. Optimum results may be obtained when using a combination of various methods of application, as explained below.

Conventional high free-rosin sizing agents are known to consist of an aqueous dispersion of rosin or fortified rosin, which may be partly saponified by means of a metal base such as caustic soda or caustic potash and may also contain a protective colloid such as casein. Other conventional sizing agents are known to consist of fortified rosins which are substantially fully saponified with a metal base. All of these conventional sizing agents depend, for their sizing effect, upon the addition of aluminium sulphate to the paper stock.

It has been found that paper sizing agents of the rosin dispersion type can be prepared by incorporating into the rosin a volatile base, for example ammonia, monomethylamine, dimethylamine, trimethylamine, monoethylamine, diethylamine, triethylamine, monopropylamine, dipropylamine, monoisopropylamine, diisopropylamine, ethyl propyl amine, ethyl butylamine, di-sec-butylamine, dimethyl isobutylamine, monoethanolamine, diethanolamine, triethanolamine, N, N-dimethyl ethanolamine, morpholine, N-methyl morpholine, N-ethyl morpholine or other amines, or mixtures thereof, which will volatilize at temperatures up to 140° C. whether or not in the presence of water, in place of the metal base used in conventional rosin dispersion sizing agents, and when the paper size is added to the paper stock, in the presence of a retention aid, preferably of the polyamine type, the paper sheet will be sized irrespective of the presence of aluminium sulphate. Further, the paper size of this invention may be added to the surface of unsized paper sheets, in which case no retention aid is required.

When retention aids are employed, where it is desired to add the novel paper size to pulp slurries prior to sheet formation, any of the polyamine type retention aids conventionally used in the paper-making art may be used.

Particularly suitable retention aids of the polyamine type, and the preparation thereof, are described in the U.S. Pat. Nos. 3,406,139 and 3,527,719. These retention aids are water-soluble nitrogen-containing polymers, or water-soluble salts thereof, having a molecular weight of at least about 5,000 up to about 10,000,000 viscosity average. One class of such polymers has an exclusively carbon atom backbone chain to which there are directly attached a plurality of nitrogenous rings of the Formula I:

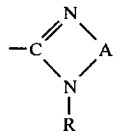

wherein:

A is an alkylene group having 2 to 3 carbon atoms, of which at least two extend in a chain between the adjacent N atoms, and R is selected from the group consisting of H, $C_1$–$C_3$ alkyl groups, hydroxy-substituted $C_1$–$C_3$ alkyl groups, and groups of the formula $-(ANH)_xH$ wherein A is as defined above and x is an integer having a value of 1 to 4.

There may also be used polymers in which the nitrogenous rings of Formula I are connected to the polymer chain through a phenylene group or through an ester or amide linkage. Such polymers have repeating units of Formula II:

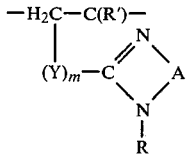

wherein:

A and R are as defined before,

R′ is selected from the group consisting of H, $C_1$–$C_2$ alkyl groups, phenyl, $C_7$-alkaryl, and

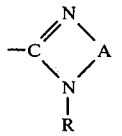

m is an integer having a value of 1 to 2, and

Y is selected from the group consisting of phenylene,

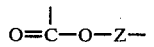

and

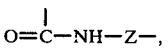

wherein Z is a $C_1$–$C_4$ alkylene group.

Polymers containing units of Formula II may be made water soluble by converting them to the salt form with any organic or inorganic acid or acid salt, for example: hydrochloric acid, sulfuric acid, p-toluenesulfonic acid, or sodium bisulfate.

Examples of suitable polyamine type retention aids are: the sodium bisulfate salt of a 2-vinyl-2-imidazoline polymer, obtained by reaction of ethylenediamine with a polyacrylonitrile having a molecular weight of about 18,000; the sodium bisulfate salt of a polymer of 2-isopropenyl-imidazoline-2, obtained by reacting ethylenediamine on a polymethacrylonitrile having a molecular weight of about 15,000; a polymer of 2-vinyl-3,4,5,6-tetrahydropyrimidine obtained by reacting trimethylenediamine on a polyacrylonitrile having a molecular weight of about 30,000; the hydrochloric acid salt of a polymer of 2-vinyl-4-methyl-2-imidazoline, obtained by the reaction of 1, 2-diaminopropane on a polyacrylonitrile having a molecular weight of about 15,000; a homopolymer of 2-vinyl-2-imidazoline obtained from a polyacrylonitrile having a molecular weight of about 1,500,000; a copolymer of 2-vinyl-2-imidazoline obtained from a copolymer of 50 mole percent acrylonitrile and 50 mole percent methyl acrylate having a molecular weight of about 900,000; and the product sold by the Rohm and Haas Company under the trade name Lufax 295, In putting the present invention into effect, a modified rosin is made by reacting an alpha, beta unsaturated mono- or dicarboxylic acid or anhydride with a rosin and then making an aqueous rosin dispersion.

The preparation of the modified, or fortified, rosin essentially requires a reaction of the Diels-Alder type, in which the alpha, beta unsaturated mono- or dicarboxylic acid or anhydride combines with the conjugated double bond system present in the rosin.

Of the many alpha, beta-unsaturated carboxylic acids and anhydrides which will undergo a reaction with rosin, acrylic acid, maleic acid, fumaric acid, itaconic acid, citraconic acid, and, most preferably, maleic anhydride, may advantageously be used in carrying the invention into effect. The other ingredients used in the preparation of the desired modified rosin reaction product may comprise any rosin which includes colophony and may consist of tall oil rosin, wood rosin or gum rosin, in their crude state or in their refined state, or a number of derivatives thereof.

A rosin including colophony may be diluted by the addition of more economical materials, for example crude tall oil, distilled tall oil, hydrocarbon resins and waxes of various types or other suitable diluents.

The hydrocarbon resins useful in the sizing compositions of the present invention are those conventionally used in the paper sizing art. They are monocrystalline thermoplastic hydrocarbon resins of straight chain and cycloaliphatic structure and essentially free from aromatic groups, having ring-and-ball softening points from 45° C. to 150° C., and molecular weights of from 350 to 2,000. Preferred hydrocarbon resins are those having a ring-and-ball softening point in the range 100°–120° C. and a molecular weight of approximately 1400. Suitable examples are the resins sold by Esso Petroleum Co. under the tradename Escorez 1102B, and by Imperial Chemical Industries under the tradename Imprez 100.

Any of the waxes conventionally used in the paper sizing art can be employed. Paraffin waxes and microcrystalline waxes are preferred, and fully refined paraffin wax having a melting point range of 60°–65° C. is particularly preferred.

The improved paper sizing agent of this invention may be prepared in the following general manner, which may be taken as being by way of an example.

Preparation of Modified Rosin

A known quantity of rosin, which expression for this purpose includes any material containing colophony, thereby having a conjugated double bond in the molecule, such as tall oil rosin, wood rosin or gum rosin, is melted and raised to an elevated temperature, (in order to prevent crystallisation of the sizing agent, tall oil rosin or other rosins which have a tendency to crystallise should be treated at elevated temperatures with formaldehyde or paraformaldehyde in the presence of an acid catalyst, for example p-toluene-sulphonic acid, in a manner well-known to those skilled in the art), and a calculated quantity of an alpha,beta-unsaturated carboxylic acid or anhydride, preferably maleic anhydride, is added to the molten heated rosin and allowed to react therewith to produce the desired modified rosin. The product will normally have a maximum softening point of 90°–92° C. (according to the Ring & Ball method of determining softening points of resinic materials.) It may be advantageous to use rosins having a lower softening point where the paper size is to be used on a paper-making machine having drying cylinder temperatures lower than normal in order to ensure sintering of the rosin.

This modified rosin need not be used immediately in the preparation of the sizing agent and is sufficiently stable to enable it to be stored until required.

Preparation of Sizing Agent

A known quantity of the modified rosin above described, together with any desired diluent, is melted, preferably in a vessel provided with stirring and heating mechanisms.

A dispersing and stabilising agent is then prepared in a separate vessel by dissolving a measured quantity of a protective colloid (for example, casein) and a measured quantity of a volatile base (for example, 0.880 ammonia) in water. As protective colloid there may be used, casein, gelatine, glue, soybean protein, zein, or other protective colloid well known to those skilled in the art, or mixtures thereof. Casein is preferred. Suitable volatile bases include ammonia, and amines which will volatilize at temperatures up to 140° C. whether or not in the presence of water, as previously explained. Mixtures of amines, or mixtures of ammonia and one or more of a suitable amine may also be employed. Ammonia is preferred as a volatile base. The quantity of volatile base used is sufficient to solubilize the protective colloid, but is limited to an amount to ensure that at least 90% of the modified rosin in the sizing agent is free, or unsaponified.

The next step in the manufacture of the sizing agent is to add quickly, to the molten rosin, the prepared dispersing and stabilising agent, making use of high speed stirring or other intensive agitation of the mixture, during and after addition.

If desired, the solids content of the resultant aqueous rosin dispersion can then be adjusted by adding a calculated quantity of water thereto. Cold water may be used for this purpose and, at the same time, for cooling the dispersion.

If it is desired to add a preservative to the dispersion to prevent bacteriological attack on the proteinaceous content, a small quantity of a microbicide or bactericide may be added before the dilution water. Any of the water-soluble or water-dispersible microbicides or bactericides known to those skilled in the art for the preservation of proteinaceous material may be used. Examples of suitable microbicides are phenols, chlorinated phenols, benzoic acid, salicylic acid, formaldehyde, organomercurial compounds, sodium o-phenylphenate, and the beta-hydroxyethylpyridinium salt of 2-mercaptobenzothiazole.

In order that the invention may be readily understood by those skilled in the art, certain preferred embodiments thereof are set out in the following examples, of which Example I describes the preparation of a modified rosin; Examples II–V the preparation of the sizing agent; and Examples VI–IX methods of sizing paper, using the sizing agent.

EXAMPLE I 1,000 kg of tall oil rosin were melted in a heated and stirrable vessel and maintained at a temperature of 165° to 170° C. 1 kg of p-toluene-sulphonic acid was added to the rosin and allowed to mix thoroughly.

20 kg of paraformaldehyde (82%) was then added to the rosin mixture and the reaction allowed to proceed to completion in about 15 minutes, the stated temperature being maintained.

Approximately 50 kg of maleic anhydride was added to the molten, paraformaldehyde-treated rosin and the resulting exothermic reaction allowed to proceed to completion in approximately 30 minutes. The modified rosin so formed had a final softening point of 90°–92° C. (R and B).

The modified rosin so formed may be immediately used for the manufacture of the rosin dispersion sizing agent, or may be allowed to cool for storage.

EXAMPLE II 560 kg of a modified rosin, for instance the product made in accordance with Example I, was melted in a heated vessel, fitted with a stirring mechanism suitable for intensively agitating its contents, and the molten rosin was stirred at approximately 300 revolutions per minute.

The temperature of the rosin was adjusted to 100° C.

The emulsifying and stabilising agent was prepared in a separate vessel, by adding 14 kg of casein to 75 l water, heated to 30° to 60° C., followed by the addition of 10 kg of 0.880 ammonia.

This dispersing and stabilising agent was then added to the molten rosin as quickly as possible and the intensive agitation was continued for a further 5 minutes, at the end of which time 0.5 kg of sodium o-phenyl-phenate was added.

The resulting dispersion was then diluted with cold water until a solids content of 45% was reached.

EXAMPLE III 390 kg. of a modified rosin, made in accordance with the procedure of Example I, was melted in a heated vessel fitted with a stirring mechanism suitable for intensively agitating its contents, and the molten rosin was stirred at approximately 300 revolutions per minute. 170 kg. of a molten hydrocarbon resin, Escorez 1102B (Esso Petroleum Co.), was added to the modified rosin.

The temperature of the rosin mixture was adjusted to 100° C.

The emulsifying and stabilising agent was prepared in a separate vessel, by adding 14 Kg. of casein to 75 liters water, heated to 30° C. to 60° C., followed by the addition of 10 Kg. of 0.880 ammonia. This dispersing and stabilising agent was then added to the molten rosin as quickly as possible, and the intensive agitation was continued for a further five minutes, at the end of which time 0.5 Kg. of sodium o-phenyl-phenate was added.

The resulting dispersion was then diluted with cold water until a solids content of 45% was reached.

EXAMPLE IV

500 Kg. of a modified rosin, for instance the product made in accordance with Example I, was melted in a heated vessel, fitted with a stirring mechanism suitable for intensively agitating its contents, and the molten rosin was stirred at approximately 300 revolutions per minute.

The temperature of the rosin was adjusted to 100° C.

The emulsifying and stabilising agent was prepared in a separate vessel, by adding 14 Kg. of casein to 75 liters water, heated to 30° C. to 60° C., followed by the addition of 10 Kg. of 0.880 ammonia.

The emulsifying and stabilising agent was added to the molten rosin and the intensive agitation was continued for 5 minutes.

60 Kg. of a fully refined paraffin was (melting point 60° C.–65° C.) was melted in a heated vessel and brought to a temperature of 80° C. and added to the dispersed rosin mixture, and the intensive agitation continued for a further five minutes, at the end of which time 0.5 Kg. of sodium o-phenyl-phenate was added. The resulting dispersion was then diluted with cold water until a solids content of 45% was reached.

EXAMPLE V

A preferred method of incorporation wax into the emulsion would be to mix with suitable agitation an anionically stabilised wax emulsion with an emulsion prepared as illustrated in Example II.

EXAMPLE VI

Bleached sulphite pulp was beaten and refined in a normal paper machine system and an MG paper of 38 mg/m$^2$ was manufactured from it on a normal MG paper machine.

No alum was added to the paper stock. 0.5% of the retention aid manufactured by Rohm and Haas under the name Lufax 295 (a cationic salt of a complex polyamine) was added to the paper stock at the head box and 1.6% (as solids to paper fibre) of a rosin dispersion size, as typified by the product of Example II above, was added at the centri-screen.

Degree of sizing as measured by the Cobb method, on paper made with the above stock, ranged from 24–30 gm/m$^2$. Initially, the pH of the stock was 4.2, but this was later adjusted to 6.8 with calcium carbonate, when the Cobb size test continued to give results of 27 gm/m$^2$.

EXAMPLE VII

A mixture of bleached sulphite and bleached sulphate chemical wood pulps was beaten in a normal paper-machine stock preparation system and paper was made on a fourdrinier paper machine. 0.9% by weight (based on the dry fiber) of aluminium sulphate was added at the wet-end of the machine. No sizing agent was added to the paper stock.

A coating mixture consisting of a 6% solution of starch and containing 1% calcium carbonate and 0.5% of the sizing agent referred to in Example I was added to the surface of the paper sheet at a size press. The resulting paper sheet when tested by the Cobb method gave a degree of sizing of 17-18 g.s.m.

EXAMPLE VIII

A sizing dispersion agent made according to Example III was applied by a spray apparatus to a paper sheet during its formation on the wire of a paper making machine. No other chemical additives were present. 1.25% by weight (based on the dry fiber) of the sizing dispersion agent was added. The degree of sizing according to the Cobb method was 25 g.s.m.

EXAMPLE IX

A paper stock was prepared in the laboratory from bleached sulphite pulp, without any other additions, and was made into sheet.

A rosin dispersion sizing agent made according to Example II above was applied to one surface of the sheets and, after drying, the sheets were tested according to the Cobb test procedure, giving the following results:

| Pick-up of Sizing Agent as % of weight of paper fibre | Cobb (gm/m$^2$) |
|---|---|
| 0.2 | 21 |
| 0.5 | 17 |
| 1.0 | 15 |
| 1.4 | 15 |

No polyamine was used in the paper stock of this example.

The above Examples show that the rosin-based paper sizing agent of the invention gives highly satisfactory products, both when the sizing agent is added to the paper stock with a polyamine retention aid or when the sizing agent is applied to unsized sheeted stock in the absence of a retention aid.

We claim:

1. A method for the preparation of sized cellulosic paper in the absence of aluminum sulfate which comprises adding a polyamine retention aid and a stable aqueous dispersion of fortified rosin to a cellulosic paper pulp slurry, forming a sheet from the pulp slurry, and drying the resultant sheet; said aqueous dispersion comprising water, a protective colloid, a volatile base and fortified rosin, at least 90% of said fortified rosin being unsaponified.

2. The method of claim 1 wherein the protective colloid is casein, the volatile base is ammonia, and the fortified rosin is tall oil rosin fortified by reaction with formaldehyde or paraformaldehyde in the presence of an acid catalyst and an alpha, beta unsaturated carboxylic acid or anhydride.

3. The method of claim 1 wherein the polyamine retention aid is a water soluble addition polymer, or a water soluble salt thereof, of monoethylenically unsaturated molecules, at least 50 mole percent of said polymer consisting essentially of repeating units of the formula

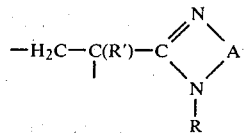

wherein A is an alkylene group having 2 to 3 carbon atoms, of which at least two extend in a chain between the adjoined N atoms, R′ is selected from the group consisting of H and methyl, and R is selected from the group consisting of H, $C_1$–$C_3$ alkyl groups, hydroxy-substituted $C_1$–$C_3$ alkyl groups, and groups of the formula -$(ANH)_xH$ wherein A is as defined above and x is an integer having a value of 1 to 4.

4. The method of claim 1 wherein the polyamine retention aid is a water-soluble addition polymer, or a water soluble salt thereof, of monoethylenically unsaturated molecules, at least 50 mole percent of said polymer consisting essentially of repeating units of the formula

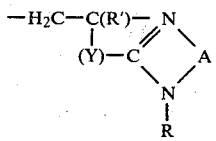

wherein A is an alkylene group having 2 to 3 carbon atoms, of which at least two extend in a chain between the adjoined N atoms′, R′ is selected from the group consisting of H, $C_1$–$C_2$ alkyl, phenyl, $C_7$ alkaryl and

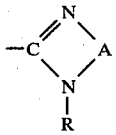

Y is selected from the group consisting of phenylene,

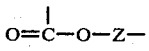

and O=C—NH—Z— wherein Z is a $C_1$–$C_4$ alkylene group; and R is selected from the group consisting of H, $C_1$–$C_3$ alkyl groups, hydroxy-substituted $C_1$–$C_3$ alkyl groups, and groups of the formula -$(ANH)_xH$ wherein A is as defined above and x is an integer having a value of 1 to 4.

5. Sized cellulosic paper prepared by the method of claim 1.

6. Sized cellulosic paper prepared by the method of claim 3.

7. Sized cellulosic paper prepared by the method of claim 4.

* * * * *

UNITED STATES PATENT OFFICE

CERTIFICATE OF CORRECTION

PATENT NO. : 4,323,425
DATED : Apr. 6, 1982
INVENTOR(S) : Edwin Dowthwaite and Ian R. Hiskens It is certified that error appears in the above-identified patent and that said Letters Patent are hereby corrected as shown below:

Column 3, line 49, change "monocrystalline" to -- noncrystalline -- line 56, change "120°C." to -- 102°C. --

Column 6, line 41, change "mg/$m^2$" to -- gm/$m^2$ --

Signed and Sealed this

*Twenty-ninth* Day of *June 1982*

[SEAL]

*Attest:*

GERALD J. MOSSINGHOFF

*Attesting Officer*

*Commissioner of Patents and Trademarks*